US006037679A

United States Patent [19]

Pirillo

[11] Patent Number: 6,037,679

[45] Date of Patent: Mar. 14, 2000

[54] YARD DECORATIONS FOR LOW VOLTAGE TABLE

[76] Inventor: Paul M. Pirillo, 2180 Vinings La., Lawrenceville, Ga. 30043

[21] Appl. No.: 09/201,110

[22] Filed: Nov. 30, 1998

[51] Int. Cl.[7] ..... H01H 47/00; F21V 33/00

[52] U.S. Cl. ..... 307/125; 362/806

[58] Field of Search ..... 307/11, 38, 40, 307/125; 340/310.01, 310.08; 362/806, 807, 808, 249, 250, 251, 252

[56] References Cited

U.S. PATENT DOCUMENTS

| | | | |
|---|---|---|---|
| D. 347,802 | 6/1994 | Kiebasa | D11/121 |
| D. 379,777 | 6/1997 | Segan et al. . | |
| 3,872,424 | 3/1975 | Enabnit . | |
| 3,944,878 | 3/1976 | Gerontakis . | |
| 4,007,458 | 2/1977 | Hollabaugh . | |
| 4,510,778 | 4/1985 | Cotton . | |
| 4,682,079 | 7/1987 | Sanders et al. | 362/806 |
| 4,734,625 | 3/1988 | Geanous et al. . | |
| 4,826,448 | 5/1989 | Maddock . | |
| 4,866,602 | 9/1989 | Hall . | |
| 4,906,901 | 3/1990 | Carroll . | |
| 5,247,753 | 9/1993 | Yang . | |
| 5,322,717 | 6/1994 | Killian . | |
| 5,378,171 | 1/1995 | Czerlanis . | |
| 5,438,154 | 8/1995 | Segan et al. | 84/600 |
| 5,457,594 | 10/1995 | Stoll et al. . | |
| 5,550,319 | 8/1996 | Segan et al. | 84/103 |
| 5,639,157 | 6/1997 | Yeh | 362/806 |
| 5,757,672 | 5/1998 | Hoepken . | |
| 5,784,815 | 7/1998 | Hermanson . | |
| 5,785,413 | 7/1998 | Tillinghast et al. . | |

FOREIGN PATENT DOCUMENTS

WO 98/18187 4/1998 WIPO .

*Primary Examiner*—Jeffrey Gaffin
*Assistant Examiner*—Rios Roberto

[57] ABSTRACT

A low voltage yard decoration system uses a power supply and cable, previously intended only for lighting systems, to improve safety, facilitate installation, and increase utility of various decoration designs. The low voltage decorations are an alternative to decorations requiring direct connection to an AC outlet. Where decorations contain lamps, a switch in each decoration allows on-off control of lamps from within the decoration itself. Decorations may also contain electric motors, and these too may be switched from within the decoration. Decoration units attach to the low voltage cable using connectors containing contacts which pierce the insulation of the cable. No tools are required for installation. Decorations may be added to existing low voltage lighting systems or installed as a standalone system. A timer may be present in each decoration, to initiate switching on or off of lamps or motors within the decoration. Decorations may also be remotely controlled through the transmission of control signals over the low voltage cable. Receipt of control signals initiates switching on or off of lamps or motors within decorations equipped with an appropriate receiver circuit. Decorations may also have an associated identification code. This allows transmitted control signals to be addressed to a specific decoration or group of decorations.

16 Claims, 6 Drawing Sheets

YARD DECORATIONS FOR LOW VOLTAGE TABLE

CROSS REFERENCE TO RELATED APPLICATION

This invention uses the electrical connections, audio devices, and communications apparatus of my co-pending application, Ser. No. 09/153,667, filed Sept. 15, 1998.

BACKGROUND OF THE INVENTION

This invention relates to electrically powered devices used as lawn and garden decorations, for holidays and other purposes.

Holiday decorations containing lamps and moving parts have been popular for both indoor and outdoor use for many years. Lighting devices include many types of miniature light sets with flashing lamps, and Rudolph the Reindeer's flashing red nose leading Santa's sleigh. Moving devices include such favorites as Santa Claus waving to onlookers, and toy trains and Ferris wheels in motion.

Non-holiday uses of similar devices include advertising signs with flashing lights, and miniature waterwheels.

These prior art devices usually receive power from an AC outlet, which in the U.S. is a 120 volt AC power source. Although there have been safety improvements over the years, the basic dangers of this potentially lethal voltage level still exist.

By design, the decorations attract children. Children want to touch the devices and could contact the power source accidentally. Pets, or even wildlife, can encounter the same fate.

The high voltage is a hazard when the decorations or cords are exposed to moisture. Rain or snow could provide a path for high voltage to reach what would normally be a non-energized area of the decoration. Because of this danger, the types of decorations that can be implemented outdoors are limited. Some must be restricted to indoor use only.

Each light set or device must be plugged into the AC power separately. This yields a large tangle of wires and extension cords if the user has several such devices in operation. The exposed cords further enhance the danger to children and pets. No matter how safe the decorations themselves are, the cords always present a hazard.

Holiday decorations frequently allow the power plugs to be stacked, so that many can share an AC outlet. The stack of plugs has a large number of points where children, animals, or moisture can contact the high voltage. The stack of plugs tends to come apart under its own weight, exposing energized conductors.

Users frequently purchase a separate timer to provide automatic on/off control of their decorations. Often no attention is paid to obtaining an outdoor rated timer for an outdoor installation. And many timers have only one socket, requiring extension cords and stacked plugs to deliver the power to many devices at once. The timer powers all attached equipment on or off simultaneously, with no ability to select which equipment is on and which is off.

Battery-powered decorations are available to overcome the safety hazards of the high AC voltage. However, batteries cannot power a medium or large-sized installation economically. Hundreds of watts of power may be necessary to operate several light sets and associated motorized devices. And batteries contain heavy metals and other substances harmful to the environment when they are disposed of.

U.S. Pat. No. 3,944,878 to Gerontakis (1976) describes a method of energizing multiple lights in a number of predetermined sequences. However, this requires multiple lighting circuits, and therefore cannot be implemented on a two-wire cable.

U.S. Pat. No. 5,784,815 to Hermanson (1998) shows a decoration featuring motorized movement, lighting, and an electrically insulating shield over some components. However, as with other prior art devices, it is powered by standard AC power (120 volts, U.S.).

U.S. Pat. No. 5,322,717 to Killian (1994) shows an outdoor ornament with motor, sound generation, and trigger devices such as a clock, photocell, or microphone. However this device is powered by wires entering its base, not by a two-conductor low voltage cable, and lacks an insulation-piercing connector.

U.S. Pat. No. 5,785,413 to Tillinghast et al. (1998) describes a vehicle light fixture which can be individually addressed for on/off control. However, power and commands are received on separate buses. Therefore a minimum of four wires are necessary.

U.S. Pat. No. 4,734,625 to Geanous et al. (1988) allows control of multiple low-voltage lamps from a remote point. However, each lamp requires its own circuit, again making it impossible to connect the whole system to a single two-wire bus.

Prior art low voltage lighting systems, including the widely used 12 volt AC systems manufactured by Intermatic Inc. (Spring Grove, Ill.), Noma Inc. (Scarborough, Canada), and Toro Co. (Bloomington, Minn.), allow on-off control of an entire string of lights through a switch located in the low voltage power supply. However, these systems do not provide on/off or flashing control of individual light fixtures. A high frequency system described in U.S. Pat. No. 4,906,901 to Carroll (1990) suffers the same limitations.

U.S. Pat. No. 5,247,753 to Yang (1993) allows attachment of a motorized decoration to a miniature light set used on a Christmas tree. This arrangement uses standard AC power and series-connected devices. The advantages of a parallel-connected bus, low voltage, and insulation-piercing connectors are thus lost.

U.S. Design Pat. No. D379,777 to Segan et al. (1997) illustrates a decoration containing multiple motorized components connected together by fixed length wires. There is no ability to connect an arbitrary number of decorations at varying distances from each other. Although not shown in the drawings, in practice this type of decoration plugs into a standard AC outlet and is intended for indoor use only.

OBJECTS AND ADVANTAGES

Accordingly, several objects and advantages of my invention are:

(a) to eliminate the high voltage power source from decorations that may come in contact with people or animals;

(b) to eliminate the need for extension cords and stacked power plugs, while reducing the complexity of wiring used for installation of a multitude of decorations;

(c) to enable outdoor use of devices previously limited to use indoors due to potential dangers of moisture contacting high voltage points;

(d) to eliminate the need for batteries to power decorations;

(e) to provide an easy method of installing low voltage decorations;

(f) to enhance the utility of low voltage lighting systems by providing decorations as an attachment to add to an existing system;

(g) to allow a device connected to a low-voltage cable to switch itself on or off, or signal other devices to switch on or off, thus further enhancing the utility of low voltage lighting systems.

SUMMARY OF THE INVENTION

The present invention overcomes the limitations of the prior art, and achieves the objects and advantages identified above, by using the low voltage cable as the power source for holiday decorations containing lamps or motors.

A set of decorations previously wired together permanently is now implemented in a modular fashion. Each decoration is installed independently of the others. Decorations attach to the low voltage cable using connectors with contacts that pierce the insulation of the low voltage cable. The connector, a prior art device, requires no tools for installation.

Decorations connected to the low voltage cable may also contain audio devices, including amplifiers and loudspeakers.

A variation allows each decoration to contain an on/off switch, or circuitry to flash lamps present on the decoration. This allows lighting control independent of a central timer device.

An enhancement provides for control information to be transmitted between decorations, through the low voltage cable. This allows for remote on-off control or lamp flashing control. The user may push buttons on one decoration to control other decorations. Or circuitry present in a decoration may automatically control other decorations.

If an identification switch is added to the decorations, it is possible to remotely control several groups of decorations independently of each other. This allows the user to create "zones" of decoration operation. It can also be used to allow several unrelated sets of decorations to be installed and operated simultaneously on the same low voltage cable.

DRAWING FIGURES

DESCRIPTION OF THE INVENTION

Main Embodiment Description—FIGS. 1–4

Figure 1:
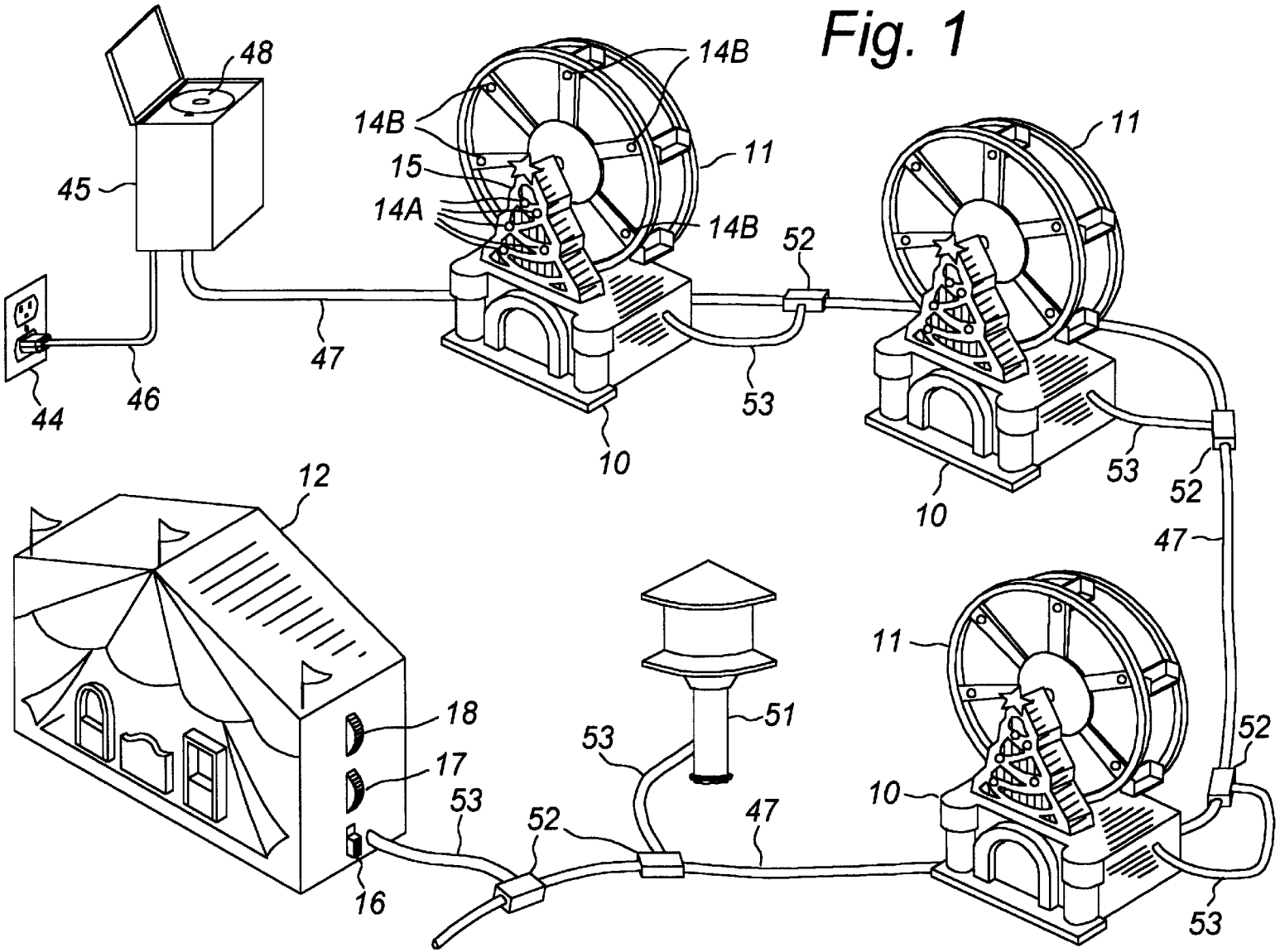
FIG. 1 shows the main embodiment, consisting of multiple decorations sharing a low-voltage power cable.

A typical embodiment of the invention is shown in FIG. 1. The decorations of U.S. Design Pat. No. D379,777 to Segan, et al. (1997) are adapted to a low voltage cable and gain the benefits of low voltage operation as described above.

A low voltage power supply 45 connects to a twin-lead low-voltage cable 47. The supply has AC power cord 46 which plugs into AC outlet 44. This power supply is implemented as a step-down transformer, reducing 120 volts AC to 12 volts AC. However, use of a DC power supply or other voltages is also possible. The key to voltage selection is to keep the voltage low enough to ensure personal safety in case of contact with energized conductors in the decoration or wiring. Safety agencies such as Underwriters Laboratories (UL) typically define the limit for "safe" voltages to be in the range of 20–30 volts, depending on the application and the maximum current the power supply provides. The "Safety Extra Low Voltage" (SELV) definitions in product safety standards are useful in understanding acceptable low voltage limits.

The remainder of the equipment shown in FIG. 1 receives power from the low voltage cable 47. Each Ferris wheel decoration consists of a base 10 and rotating wheel 11. Base 10 contains a motor used to rotate the wheel. Low voltage connector 52 is attached to a two conductor wire 53, which carries power to the internal components of the base 10. Stand 15 supports the axle of the wheel 11 and hides the drive mechanism that rotates the wheel.

The stand 15 has the appearance of a Christmas tree, and features lamps 14A to enhance this appearance. The wheel 11 features lamps 14B to further enhance the appearance and motion of the decoration, especially under low light conditions. The lamps are miniature incandescent bulbs. However, light emitting diodes (LEDs) could also be used. LEDs need extra support circuitry compared to incandescent bulbs, but are small and available in red and green colors widely used on holiday decorations.

The base module decoration 12 connects to the low voltage cable using connector 52 and wire 53. This decoration contains a loudspeaker, amplifier, and an audio circuit to produce musical sounds. Decoration 12 also contains on/off switch 16, volume control thumbwheel 17, and speed control thumbwheel 18.

A low voltage light fixture 51 is also connected to low voltage cable 47. The holiday decoration of this invention, consisting of the three Ferris wheels plus the base module decoration, can be installed onto an existing low voltage lighting system without the need to remove any light fixtures.

Figure 2A:
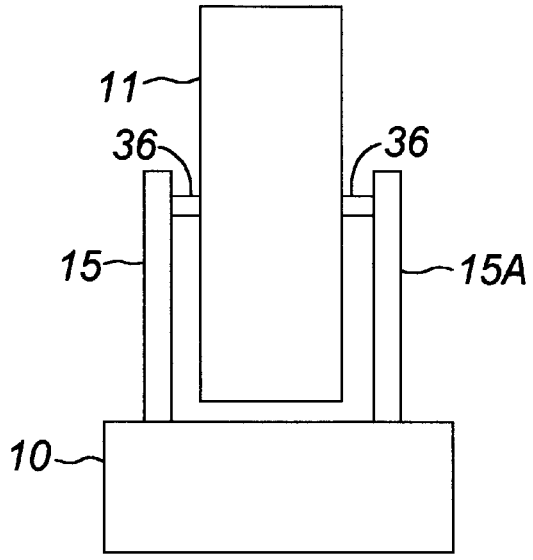
FIG. 2A shows a simplified side view of one of the Ferris wheel decorations.

FIG. 2A shows a side view of the Ferris wheel decoration, with ornamental details omitted to provide a clear view of the basic components. Wheel 11 rotates on its axle 36. Stand 15, and rear stand 15A support the axle 36 of the wheel, holding the wheel above base 10. Rear stand 15A is similar in appearance and function to stand 15, so that the decoration has a uniform appearance as viewed from any direction.

Figure 2B:
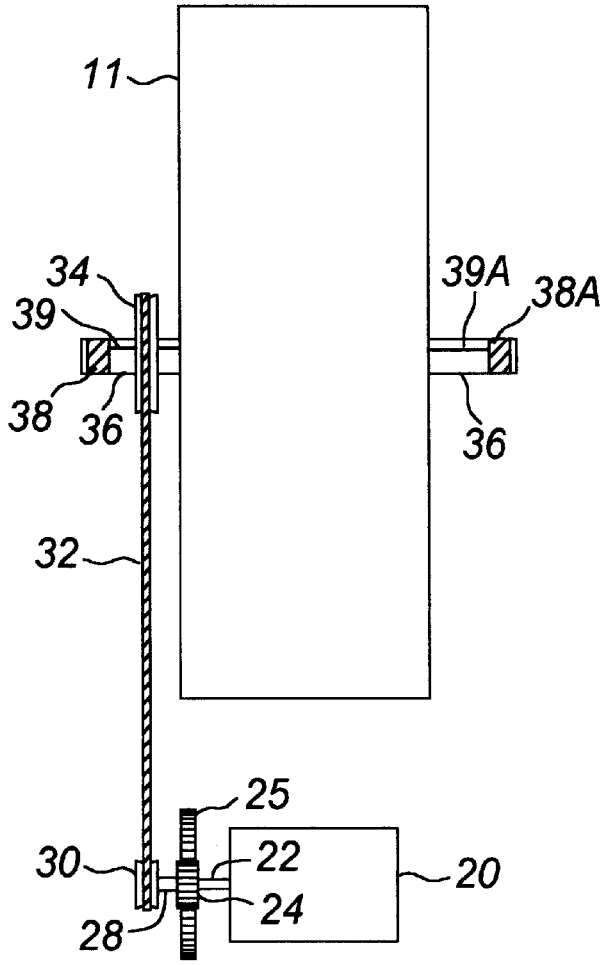
FIG. 2B shows the side view with portions of the decoration housing removed to expose the internal mechanism.

FIG. 2B shows the side view with the outer housing of base 10 and stands 15 and 15A removed. Within the base 10 of the decoration, motor 20 includes rotating shaft 22. Drive gear 24 is mounted on the shaft 22 and meshes with reducing gear 25. The reducing gear and drive pulley 30 share axle 28.

Above the base 10, normally hidden from view by the stand 15, driven pulley 34 is located on the Ferris wheel's axle 36. Belt 32 is mounted on the two pulleys.

A simple contact mechanism powers the lamps 14B in the rotating Ferris wheel 11. Conductive foil strips 38 and 38A are wrapped around each end of axle 36. Wires 39 and 39A connect each foil strip to the lamps 14B, which are located within the Ferris wheel 11 and not shown in this view. The conductive strips 38 and 38A contact brushes located within stands 15 and 15A, allowing electric current to pass from the base 10 to the wheel 11. The wires 39 and 39A complete the circuit to the lamps 14B contained within the wheel 10.

Figure 3:
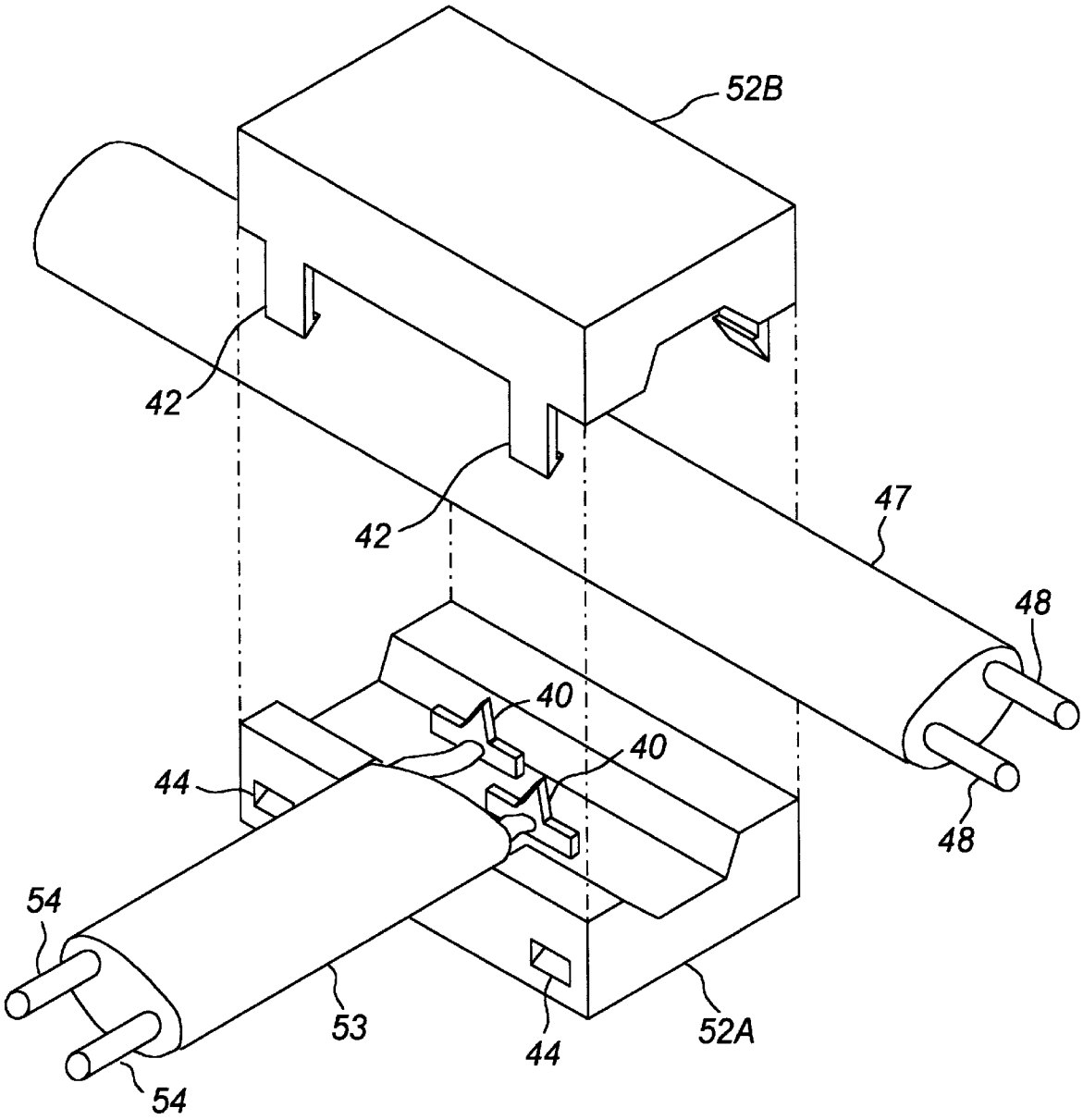
Fig. 3 Prior Art
FIG. 3 shows a prior art low voltage cable connector. The purpose of this drawing is to identify the key components of such connectors to improve understanding of the present invention.

The decoration of FIGS. 1 and 2 operates as follows. The user installs each component of the decoration by placing it near the low voltage cable 47 and attaching the low voltage connector 52 to the cable. FIG. 3 details the connector installation. Power supply 45 converts U.S. line voltage of 120 volts AC to 12 volts AC, which is applied to cable 47 and the devices connected to the cable. A timer within the low voltage power supply 45 automatically energizes and de-energizes the cable 47. The user sets the on/off times using timer dial 48. Base module decoration 12 produces musical sounds, using apparatus shown in FIG. 5A. Volume control 17 adjusts music volume. Switch 16 turns power to the base module on or off.

Each Ferris Wheel 11 rotates in response to the application of power to the cable 47. Shaft 22 of motor 20 rotates at a relatively high rate. Drive gear 24 rotates with the shaft and in turn rotates the larger reducing gear 25 and drive pulley 30. Belt 32 turns the larger driven pulley 34, rotating the Ferris wheel. The gears and pulleys are sized to reduce the revolution rate of the Ferris wheel to a reasonable value.

In the above described operation, each decoration operates independently of the others also present on low voltage cable 47. However, greater ease of use and functionality of the decoration set is possible if decorations can control each other's operation. Additional features provided in base module decoration 12 enable it to control the Ferris wheel decorations. When decoration 12 is turned on using switch 16, it emits a stream of voltage pulses that are carried by the low voltage cable 47 to the Ferris wheel decorations. A receiver circuit in each Ferris wheel decoration senses these pulses, and causes the Ferris wheel to begin operation.

Speed control thumbwheel 18 on base module 12 changes the rate at which pulses are transmitted over cable 47. The receiver circuit in each Ferris wheel signals a motor speed control circuit, which changes the rotation rate of the motor and thus of the Ferris wheel. A higher pulse rate results in faster rotation. The absence of pulses, which occurs when base module 12 is switched off, causes the Ferris wheels to cease operation.

The switch 16 allows the user to keep the power supply 45 energized at all times, while retaining the ability to switch on or off individual low voltage devices. This is a significant improvement over the prior art, which uses the timer in power supply 45 to switch on or off all of the low voltage equipment simultaneously.

An on-off switch applies to lighting devices as well. Apparatus that will be described in FIGS. 4 and 5B, used to flash lamps, can also serve as a simple on-off switch. Just as the motor speed can be remotely controlled, so can the lamp operation. Lamps can be switched on or off remotely, or can be made to flash at varying rates.

FIG. 3 shows the detail of the low voltage connector 52. There are many such connectors described in the prior art. Although these connectors have widely varying appearances, each contains basic features similar to those illustrated in FIG. 3. The reader is advised to review U.S. Pat. No. 4,826,448 to Maddock (1989) and U.S. Pat. No. 5,378,171 to Czerlanis (1995) for full details on the installation and construction of typical low voltage connectors.

The body of connector 52 consists of bottom housing 52A and top housing 52B. These two parts are made of a resilient but electrically insulating material such as polycarbonate plastic. Bottom housing 52A contains two electrical contacts 40 made of brass or other conductive materials. The two conductors 54 of wire 53 are crimped or soldered to the contacts 40. The wire 53 extends away from the connector housing and delivers low voltage power to the light fixture, decoration, or other connected device.

A depression in bottom housing 52A receives low voltage cable 47. This depression aligns the cable axis to that of the connector. Contacts 40 each have a protruding sharp point that can penetrate the insulating jacket of cable 47. The contacts are offset from each other within the connector housing so that each contact aligns with a conductor 48 of cable 47. To install the connector, the user lays the cable 47 over the contacts 40 in the bottom housing 52A. Then top housing 52B is pressed down onto the cable 47, pushing the cable against the contacts 40 with sufficient force to pierce the insulation. When the top housing 52B is fully seated, clips 42 on the top housing snap into notches 44 on the lower housing 52A. This fastens the top and bottom parts of the housing together, securing cable 47.

Figure 4:
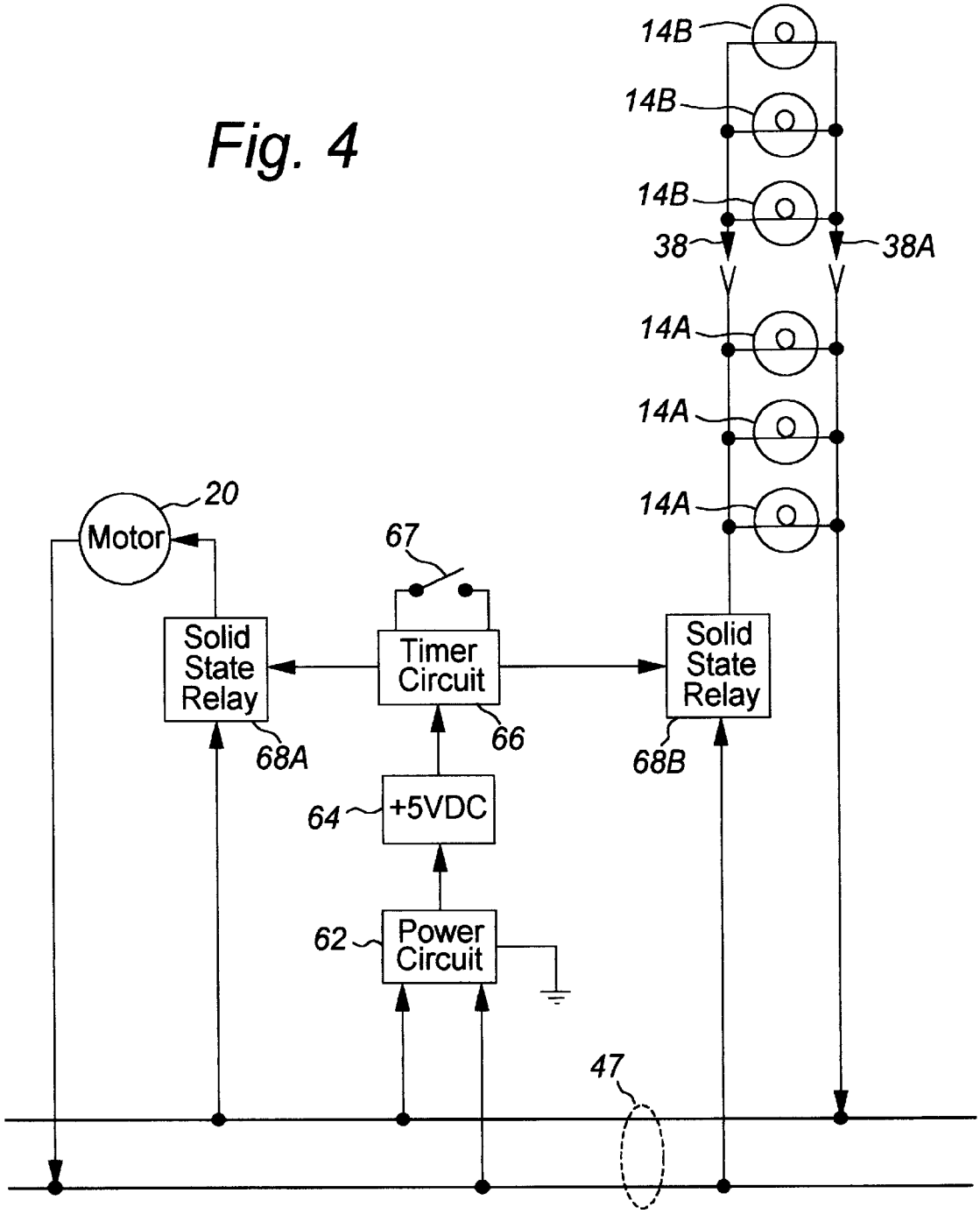
FIG. 4 is an electrical block diagram of the Ferris wheel decoration.

FIG. 4 is a block diagram of the electrical components of the Ferris wheel decoration. A motor and lamps in this decoration draw power from low voltage cable 47. Connector 52 and wire 53 (FIGS. 1 and 3) interface the components of the decoration to the low voltage cable. DC power for electronic components is provided by power circuit 62, which contains a bridge rectifier, ripple/lowpass filter, and a voltage regulator circuit. This produces output voltage 64. Timer circuit 66 outputs an enabling signal to solid state relays 68A and 68B. The timer circuit uses a 555 integrated circuit with RC timing network. Solid state relay 68A, when energized by the enabling signal, passes electric current to the motor 20, causing the motor shaft to rotate. Each Ferris wheel decoration contains an on-off switch 67 similar to switch 16 visible on base module 12. When the switch is in the off position, timer circuit 66 does not issue enabling signals to solid state relays 68A and 68B. Thus the motor and lamps do not operate.

The timer circuit 66 and solid state relay 68A allow periodic operation of the motor 20, if the user desires. In many applications, however, the motor is allowed to operate any time the low voltage cable 47 is energized. In this case solid state relay 68A is omitted, and both terminals of motor 20 are connected directly to the low voltage cable.

Solid state relay 68B allows the lamps 14A and 14B to flash in response to timer circuit 66. The lamps are connected in parallel across the low voltage cable. Therefore, when solid state relay 68B is energized, all lamps receive the full voltage present on the cable. Current flows through the foil strip contacts 38 and 38A located on the Ferris wheel axle, to power the lamps 14B on the Ferris wheel. If a lamp burns out, the others continue to operate since all are connected in parallel across the power source.

Figure 5A:
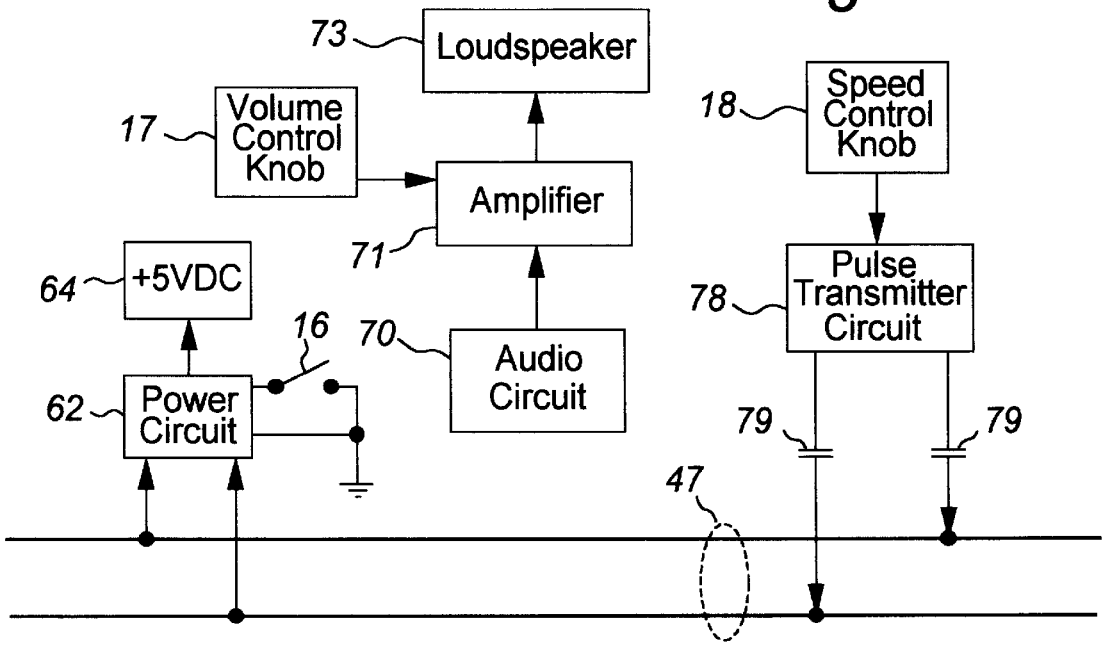
FIG. 5A is an electrical block diagram of the base module decoration, including a circuit used to remotely control other equipment sharing the low voltage cable.
Figure 5B:
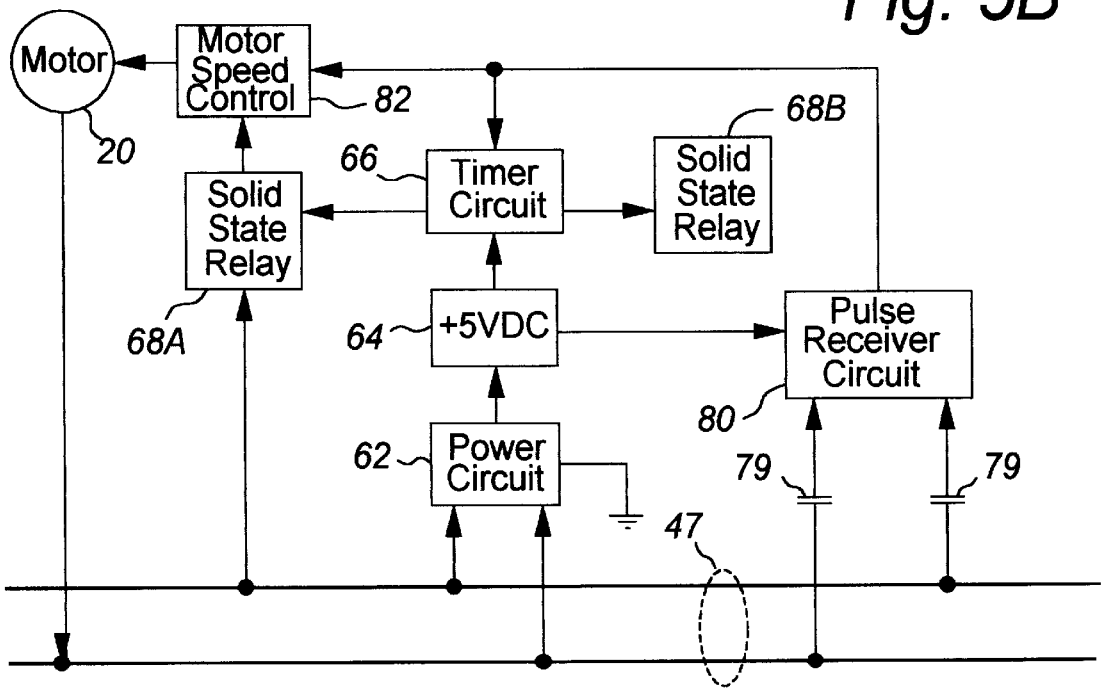
FIG. 5B is a block diagram of the Ferris wheel decoration, with enhancements permitting the decoration to be remotely controlled.

Description and Operation—FIGS. 5A and 5B

FIG. 5A is a block diagram of the electrical components of base module decoration 12. DC power for electronic components is provided by power circuit 62, which contains a bridge rectifier, ripple/lowpass filter, and a voltage regulator circuit. This produces output voltage 64. The user can turn off the electronics of this decoration, using switch 16. The switch disables the power circuit 62, thereby turning off the remaining circuitry in the base module 12.

Audio circuit 70 contains an electronic tone generator that plays musical notes of varying pitch and duration. A ROM in this circuit stores musical note information needed to play one or more melodies. A digital circuit translates binary values stored in the ROM to commands that are input to the tone generator. This is a well-known technique used in battery-powered musical greeting cards and Christmas tree ornaments. Amplifier circuit 71 and loudspeaker 73 increase the sound level so that the melody is audible from a distance, as would be required for an outdoor decoration. Volume control knob 17 adjusts the gain of amplifier 71, permitting the user to set a volume level appropriate for the environment in which decoration 12 is placed. Other audio generators such as a wavetable synthesizer, or playback of sampled and digitized sounds, are also possible. The power circuit 62, and the audio components, are described in greater detail in my co-pending application Ser. No. 09/153,667.

The base module 12 can be equipped with a simple transmitter circuit that injects electrical pulses into the low voltage cable 47. A receiver circuit can be added to the Ferris wheel decorations, to detect the transmitted pulses and alter the operation of the Ferris wheel motor or lamps. The transmitter and receiver operate as follows.

Pulse transmitter circuit 78 periodically generates a 5 volt differential pulse across the two conductors of low voltage cable 47. Each pulse is several microseconds in duration. Blocking capacitors 79 isolate the pulse transmitter from the power voltage on cable 47, but allow the pulses to pass into the cable. This is possible because the 60 Hz power frequency is orders of magnitude lower than the frequency components of the pulses. The pulse width and voltage are chosen so that any lamps on the low voltage circuit do not flicker visibly in response to the pulses.

Speed control knob 18 changes the rate at which pulses are transmitted into the low voltage cable 47. Pulse transmitter circuit 78 contains an RC timing network which is influenced by the resistance value of a potentiometer connected to the speed control knob 18. The Ferris wheels respond to a faster pulse rate by increasing their rate of rotation rate and lamp flashing. When the pulse rate is reduced to its minimum value, the Ferris wheels slow, or even stop, depending on the design of the receiver in the Ferris wheels. Thus it is possible to use speed control knob 18 as an on/off switch for the Ferris wheel decorations. The pulses transmitted into cable 47 act as commands to the Ferris wheels, to continue operation.

FIG. 5B is a block diagram of the circuitry located in base 10 of each Ferris wheel decoration. In this embodiment, timer circuit 66 receives control signals from a pulse receiver circuit 80. Receiver circuit 80 generates control signals based on the rate of pulse reception from low voltage cable 47. Blocking capacitors 79 protect the receiver circuit 80 from the power voltage on cable 47, but allow the pulses to pass.

When pulses are received at a high rate, approximately 5 Hz or faster, pulse receiver circuit 80 signals timer circuit 66 to cycle at its highest rate. Solid state relays 68A and 68B are energized and de-energized at a high rate. This causes lamps 14A and 14B to flash on and off at a high rate. The lamps are connected to the output of relay 68B (as shown in FIG. 4). Motor 20 switches on and off at a high rate, causing the Ferris wheel 11 to spin and stop at a high rate.

When pulses are received at a lower rates, the pulse receiver circuit 80 signals timer circuit 66 to cycle more slowly, reducing the flashing rate of lamps 14A and 14B. Motor 20 cycles on and off more slowly. When pulses are received at rates of approximately 1 Hz or less (including the case of no pulses at all), pulse receiver circuit 80 signals the timer circuit 66 to cease operation completely. Solid state relays 68A and 68B remain in the off state. The lamps and motor do not operate.

In many applications the user will not want the motor to stop and restart while the decoration is operating. In this case the motor can be operated continuously. The pulse rate can be used to adjust the speed of the motor. An optional motor speed control circuit 82 receives control signals from the pulse receiver circuit 80. When pulses are received at a high rate, motor speed control 82 operates the motor 20 at a high rate, causing Ferris wheel 11 to rotate rapidly. Lower received pulse rates reduce the speed of the motor. The absence of pulses results in solid state relay 68A switching off, stopping motor operation.

The stated pulse rate of 1–5 Hz is relatively arbitrary. Other rates may be chosen, with slower pulse rates incurring slower response time at the Ferris wheels.

It should be clear to one skilled in differential signaling that there are other methods available to transmit information through the low voltage cable. A radio frequency carrier may be used, as described in my co-pending application Ser. No. 09/153,667. High speed baseband signaling, such as that used in Ethernet local area networks or Asymmetric Digital Subscriber Loop (ADSL) is also possible. When using baseband communication schemes, it may be necessary to reduce the transmitted voltage level or use a data scrambler to reduce DC content. Otherwise flicker of lamps connected to cable 47 may become visible. The pulse signaling method is chosen in the main embodiment of the present invention, primarily because it is inexpensive to implement.

Figure 6A:
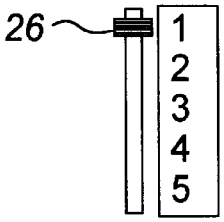
FIG. 6A shows an identification selection switch added to the Ferris wheel decorations, allowing them to be individually addressed and controlled.
Figure 6B:
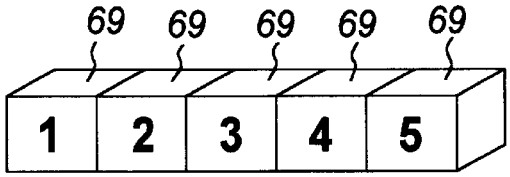
FIG. 6B shows pushbuttons added to the base module, allowing remote control of specific Ferris wheel decorations.

Description & Operation—FIGS. 6A and 6B

The main embodiment uses the base module decoration 12 to control all of the Ferris wheel decorations as a set. However, individual control of remote decorations is also possible. My co-pending application Ser. No. 09/153,667 describes a method and apparatus for remote control of individual audio devices. This method can also be applied to the decorations of the present invention. In the present invention, the RF transmitter and receiver are replaced by a pulse transmitter and receiver.

Referring to FIG. 6A, base 10 of each Ferris wheel decoration is equipped with an identification switch 26 having several numbered positions.

Referring to FIG. 6B, base module 12 is equipped with several numbered pushbuttons 69. The user depresses one of these pushbuttons to operate the Ferris wheel decorations having the corresponding identification switch setting.

The base module 12 transmits a series of pulses into the cable 47, corresponding to the depressed pushbutton. For example, if the button numbered 3 is depressed, then three pulses are transmitted. The pulse sequence has a duration of less than one second. The pushbuttons replace speed control knob 18 in FIG. 5A.

Figure 6C:
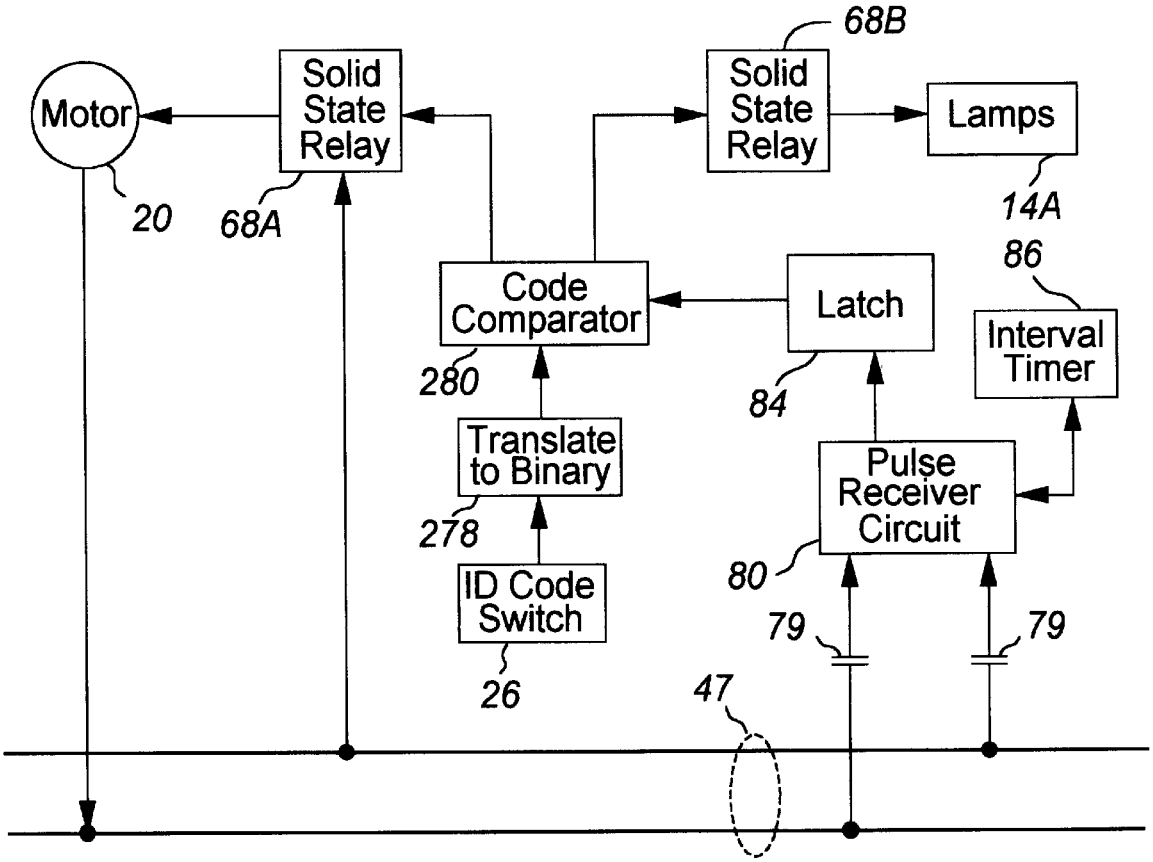
FIG. 6C shows the block diagram of the Ferris wheel decoration with identification switch.

Each Ferris wheel contains the circuit shown in FIG. 6C. This circuit allows the Ferris wheel to receive the pulse sequence from the base module. Pulse receiver circuit 80 counts the received pulses and converts the counted number to a binary value. The binary value is output to latch 84. Interval timer 86 has a period of approximately one second. The interval begins when the first pulse of the incoming pulse sequence is received. When the interval ends, receiver circuit 80 enables latch 84 to capture the binary pulse count value.

The user sets identification (ID) code switch 26 to the desired ID value. Binary translation circuit 278 converts the switch setting to a binary value. Code comparator 280 receives the binary values from the latch 84 and translation circuit 278. If the two binary values are identical, comparator 280 toggles solid state relays 68A and 68B. This causes power to be supplied to motor 20 and lamps 14A. If the binary values are not identical, then comparator 280 does not toggle the solid state relays. Thus, the circuit ignores pulse sequences intended for other decorations.

If the Ferris wheel decoration is already operating, then the solid state relays 68A and 68B are toggled from the on to the off state. Thus, the pushbuttons on the base module 12 can switch the remote decorations on or off.

If the base module 12 repeatedly transmits the pulse sequence, it should be clear that this will cause the lamps 14A of the Ferris wheel decoration to flash on and off. In this case, a circuit is added to the base module to automatically transmit one or more pulse sequences in succession. This causes each group of Ferris wheel decorations, as identified by the setting of switch 26, to flash on and off in succession. Thus, the addressing scheme provided by the switch 26 and the transmission of various pulse sequences allows various patterns of lamp flashing to be displayed, enhancing the viewing experience of the decoration system.

An identification code can also be internally "hardwired" into the decoration. In this case switch 26 is replaced by a permanently wired circuit internal to the decoration. The ID code is preset and is not adjustable by the user. This is useful when providing several sets of decorations that must operate independently on one cable, but where it is desired to reduce complexity of each decoration.

Timer circuit 66, as shown in FIG. 5B, can be added to each Ferris wheel decoration to generate lamp flashing internally. This eliminates the need for the base module 12 to control lamp flashing. In this case the pushbuttons on the base module serve as on-off switches, but each Ferris wheel decoration controls its own lamp flashing.

In the above embodiments, timer circuit 66 contains an RC timing network. However, other timing methods are also possible. A crystal-controlled timer may be used. A digital counter circuit may be used in conjunction with the RC network or the crystal.

A real-time clock circuit may also be implemented. This allows the decorations to begin or cease operations at a predetermined time of day. Rather than use a timer on low voltage power supply 45 (FIG. 1), the decorations control themselves. The low voltage cable 47 remains energized at all times The real-time clock circuit may also be used in the base module decoration 12. This decoration can thus signal the remote Ferris wheels to switch on or off at predetermined times.

Timer circuit 66 and solid state relay 68B (FIGS. 4, 5B, and 6C) could be replaced by a master flashing bulb, as used on many series-wired holiday light sets. This master bulb contains a flexible metal contact which responds to heat generated within the bulb. The contact periodically opens and closes, causing the master lamp (and all lamps in series with the master) to flash.

SUMMARY AND RAMIFICATIONS

The above descriptions frequently refer to the low voltage decorations as an attachment to a low voltage lighting system. However, it should be clear that the low voltage cable, the low voltage power supply, and the decorations can operate together without any lighting equipment sharing the low voltage cable. Therefore the scope of the invention is not limited to an improvement to low voltage lighting systems.

This invention allows increased safety in the usage of electrical decorations. Many decorations previously limited to indoor use can now be installed outdoors. Yet there are no batteries to replace.

Decorations are easily installed, relocated, or removed. No tools are required to make the electrical connections. Decorations may be added to an existing low voltage lighting system. Or the decorations, cable, and power supply may be sold, installed, and operated as a standalone system.

Decorations can use the low voltage cable to communicate with each other. This allows remote control of decorations. The user can switch all decorations on or off from one point. Or the user can switch on only a subset of the decorations. Communications can also provide enhanced visual effects, such as synchronized or sequential lamp flashing. An added advantage of the addressed communication method is that it becomes possible to operate several unrelated sets of decorations on the same low voltage cable, with no undesired interaction between these sets.

Decorations can contain audio components. This allows a full sound and light show to be implemented on a single low voltage cable.

Although the above descriptions contain many specificities, these should not be construed as limiting the scope of the invention but as merely providing illustrations of some of the presently preferred embodiments of this invention. Some examples of alternative embodiments have been cited in the text of the above description.

Thus the scope of the invention should be determined not by the embodiments illustrated, but by the appended claims and their legal equivalents.

I claim:

1. A low voltage yard decoration system, comprising:

(a) a power supply unit which plugs into a standard alternating current outlet and generates an output voltage of less than 30 volts;

(b) a two-conductor low voltage cable connected to the output terminals of said power supply unit;

(c) at least one decoration unit connected to the low voltage cable using a connector for attaching said decoration unit mechanically and electrically to the low voltage cable, said connector comprising a structure housing electrical contacts which pierce the insulation of the cable and make electrical contact to each of the two conductors, a fastening means to secure the cable to said structure and press the cable against the contacts with sufficient force to accomplish piercing of the insulation and electrical contact, and a conducting means to carry electric current from each of the contacts to power input terminals of said decoration unit;

(d) within said decoration unit, at least one lamp, and switching means that switches the flow of electrical current to at least one said lamp.

2. The decoration system of claim 1 wherein said decoration unit further comprises a timer connected to said switching means, to enable lamp current to be switched in response to the operating state of said timer.

3. The decoration system of claim 1 wherein said decoration unit further comprises a receiver circuit for receiving a control signal transmitted over the low voltage cable, said receiver circuit comprising:

(a) a connection to said power input terminals of said decoration unit;

(b) a blocking means which protects said receiver circuit from a power voltage present at said power input terminals, but allows said control signal received from the cable to pass;

(c) detection means to recover the control information present in the signal received from the low voltage and translate the information to commands usable by said switching means;

(d) a connection to said switching means, to deliver the received commands.

4. The decoration system of claim 3 wherein said receiver circuit is connected to an identification selection means, allowing said control signals to be addressed to a particular subset of decoration units.

5. A low voltage yard decoration system, comprising:

(a) a power supply unit which plugs into a standard alternating current outlet and generates an output voltage of less than 30 volts;

(b) a two-conductor low voltage cable connected to the output terminals of said power supply unit;

(c) at least one decoration unit connected to the low voltage cable using a connector for attaching said decoration unit mechanically and electrically to the low voltage cable, said connector comprising a structure housing electrical contacts which pierce the insulation of the cable and make electrical contact to each of the two conductors, a fastening means to secure the cable to said structure and press the cable against the contacts with sufficient force to accomplish piercing of the insulation and electrical contact, and a conducting means to carry electric current from each of the contacts to power input terminals of said decoration unit;

(d) within said decoration unit, at least one electric motor, and transmission means to translate the motor rotation into motion of an externally visible member of the decoration.

6. The decoration system of claim 5, wherein said decoration unit comprises switching means that switches the flow of electrical current to at least one said electric motor.

7. The decoration system of claim 6 wherein said decoration unit further comprises a timer connected to said switching means, to enable motor current to be switched in response to the operating state of said timer.

8. The decoration system of claim 6 wherein said decoration unit further comprises a receiver circuit for receiving a control signal transmitted over the low voltage cable, said receiver circuit comprising:

(a) a connection to said power input terminals of said decoration unit;

(b) a blocking means which protects said receiver circuit from a power voltage present at said power input terminals, but allows said control signal received from the cable to pass;

(c) detection means to recover the control information present in the signal received from the low voltage and translate the information to commands usable by said switching means;

(d) a connection to said switching means, to deliver the received commands.

9. The decoration system of claim 8 wherein said receiver circuit is connected to an identification selection means, allowing said control signals to be addressed to a particular subset of decoration units.

10. The decoration system of claim 5 wherein said decoration unit further comprises a motor speed control circuit coupled to said electric motor.

11. In a low voltage decoration system comprising a power supply unit connecting to standard alternating current power and generating an output of less than 30 volts, a two-conductor low voltage cable connected to the output of said power supply unit, a plurality of decoration units connected to the low voltage cable, and where at least one said decoration unit includes a receiver circuit for receiving control signals over the low voltage cable, the method of remotely controlling said decoration units comprising the steps of:

(a) in a particular one of said decoration units, accepting a stimulus to remotely control at least one of the remaining said decoration units;

(b) in response to said stimulus, transmitting a control signal onto the low voltage cable, additive with a power signal also present on the cable;

(c) in at least one said decoration unit, separating said control signal from said power signal, and in response to said control signal, switching the electrical current flow to at least one circuit within said decoration unit which received said control signal.

12. The method of claim 11 wherein said stimulus is the depression of a pushbutton by a human operator of the decoration system.

13. The method of claim 11 wherein said stimulus is the receipt of an output signal from a timer circuit located within the decoration which transmits said control signal onto the low voltage cable.

14. The method of claim 11 wherein said control signal contains addressing information which directs said control signal to a subset of said decoration units, and where decorations not belonging to said subset ignore said control signal.

15. The method of claim 14 wherein repeated transmission of said control signal, addressed to various subsets of decorations, is used to coordinate switching of lamps located within a plurality of said decoration units, for the purpose of generating various patterns of lamp illumination.

16. The method of claim 14 wherein repeated transmission of said control signal, addressed to various subsets of decorations, is used to coordinate switching of motors located within a plurality of said decoration units, for the purpose of generating various patterns of motion of visible members of said decoration units.

* * * * *